US010201055B2

(12) United States Patent
Lee

(10) Patent No.: US 10,201,055 B2
(45) Date of Patent: Feb. 5, 2019

(54) LED MODULE

(71) Applicant: Seoul Semiconductor Co., Ltd., Ansan-si (KR)

(72) Inventor: Jong Hyuk Lee, Ansan-si (KR)

(73) Assignee: Seoul Semiconductor Co., Ltd., Ansan-si (KR)

( * ) Notice: Subject to any disclaimer, the term of this patent is extended or adjusted under 35 U.S.C. 154(b) by 8 days.

(21) Appl. No.: 14/901,615

(22) PCT Filed: Jun. 27, 2014

(86) PCT No.: PCT/KR2014/005747
§ 371 (c)(1),
(2) Date: Dec. 28, 2015

(87) PCT Pub. No.: WO2014/209059
PCT Pub. Date: Dec. 31, 2014

(65) Prior Publication Data

US 2016/0374170 A1 Dec. 22, 2016

(30) Foreign Application Priority Data

Jun. 28, 2013 (KR) ..... 10-2013-0075607
Jun. 27, 2014 (KR) ..... 10-2014-0079692

(51) Int. Cl.
*H05B 37/02* (2006.01)
*H05B 33/08* (2006.01)

(52) U.S. Cl.
CPC ..... *H05B 33/0857* (2013.01); *H05B 33/083* (2013.01); *H05B 33/0824* (2013.01)

(58) Field of Classification Search
CPC ..... H05B 33/0803; H05B 33/0809; H05B 33/0821; H05B 33/0824; H05B 33/0851; H05B 37/02
(Continued)

(56) References Cited

U.S. PATENT DOCUMENTS 7,847,487 B2 * 12/2010 Kato ..... H05B 33/0803 315/185 S
8,299,724 B2 * 10/2012 Huynh ..... H05B 33/083 315/291
(Continued)

FOREIGN PATENT DOCUMENTS

JP 2005-109113 4/2005
JP 2013-030426 2/2013
(Continued)

OTHER PUBLICATIONS

International Search Report dated Nov. 6, 2014, in International Application No. PCT/KR2014/005747.
(Continued)

*Primary Examiner* — Tung X Le
(74) *Attorney, Agent, or Firm* — H.C. Park & Associates, PLC

(57) ABSTRACT

A light emitting diode (LED) module includes LEDs driven by alternating current (AC) power, and LED groups, each of the LED groups including at least two of the LEDs. The LED module is configured to divide one cycle of the AC power into sections and sequentially turn on the plurality of LED groups based on the sections of the one cycle of the AC cycle. The color temperatures of the at least two LEDs have a range of deviation from a central color temperature.

16 Claims, 7 Drawing Sheets

(58) Field of Classification Search
USPC ..... 315/185 R, 186, 192, 193, 200 R, 394
See application file for complete search history.

(56) References Cited

U.S. PATENT DOCUMENTS 9,041,303 B2 * 5/2015 Yoon ..... H05B 33/0821 315/192
2005/0242742 A1 * 11/2005 Cheang ..... H05B 33/086 315/149
2006/0109219 A1 * 5/2006 Robinson ..... G09G 3/14 345/83
2011/0228514 A1 * 9/2011 Tong ..... H01L 25/0753 362/84
2011/0273103 A1 * 11/2011 Hong ..... H05B 33/0821 315/193
2012/0262075 A1 * 10/2012 Lynch ..... H05B 33/0818 315/192
2013/0009560 A1 1/2013 Takeda et al.
2013/0278163 A1 * 10/2013 Rodriguez ..... H05B 33/0842 315/201
2014/0062313 A1 * 3/2014 Ootsubo ..... H05B 33/0869 315/158
2014/0184078 A1 * 7/2014 Hwang ..... H05B 33/083 315/122
2014/0191655 A1 * 7/2014 Kasakura ..... H05B 33/0803 315/32
2014/0210362 A1 * 7/2014 Shin ..... H05B 33/083 315/186
2014/0268697 A1 * 9/2014 Smith ..... F21S 9/022 362/183

FOREIGN PATENT DOCUMENTS

JP 2013-084564 5/2013
KR 10-2012-0018646 3/2012
KR 10-2012-0135003 12/2012
WO 2011/126106 10/2011

OTHER PUBLICATIONS

Written Opinion dated Nov. 6, 2014, in International Application No. PCT/KR2014/005747.

* cited by examiner

LED MODULE

CROSS-REFERENCE TO RELATED APPLICATIONS

This application is the national stage of International Application PCT/KR2014/005747, filed on Jun. 27, 2014, and claims priority from and the benefit of Korean Patent Application No. 10-2013-0075607, filed on Jun. 28, 2013, and Korean Patent Application No. 10-2014-0079692, filed on Jun. 27, 2014, each of which is hereby incorporated by reference for all purposes as if fully set forth herein.

BACKGROUND

Field

Exemplary embodiments relate to a light emitting diode (LED) module including a plurality of LEDs, and more particularly, to an LED module driven in response to alternating current (AC) power.

Discussion of the Background Art

As a part of low carbon green growth moving forward globally, a method of reducing illumination energy by introducing an LED lamp is being actively pushed forward.

Currently, LED lamps include a serial, parallel or serial-parallel combined group composed of a plurality of direct current (DC) LED devices, and are classified into DC drive type LED lamps, in which DC power is supplied to the LED devices through an internal or external power converter, and AC drive type LED lamps directly driven by AC power.

As shown in FIG. 1, a typical AC LED lamp includes two AC power terminals P1, P2 and a light emitting module 9. The AC power terminals P1, P2 are connected to the light emitting module 9 to directly supply AC power to the light emitting module 9.

The light emitting module 9 includes a first LED unit 91 and a second LED unit 92. Each of the first LED unit 91 and the second LED unit 92 includes at least one LED.

The first LED unit 91 and the second LED unit 92 are inversely connected to each other in parallel. Thus, the light emitting module 9 may be directly connected to an AC power source which allows the first LED unit 91 and the second LED unit 92 to alternately emit light along with AC power alternately repeating positive and negative voltage cycles.

There can be a slight deviation in color temperature of a plurality of LEDs produced from one wafer. This can be caused by various reasons such as deviation during a manufacturing process, for example, thickness deviation of a fluorescent layer coated onto an upper surface, and the like. However, since LEDs included in LED units are arranged in a typical AC LED lamp without consideration of deviation in color temperatures of the LEDs, there is a problem of difficulty in realization of a color temperature required for a final product.

SUMMARY

Exemplary embodiments provide an LED module capable of using LEDs having a color temperature deviation without deterioration in aesthetic appearance.

Exemplary embodiments provide an LED module capable of realizing a required color temperature using LEDs having a color temperature deviation.

Exemplary embodiments provide an LED module including LEDs arranged to improve uniformity of emitted light and/or heat dissipation.

In accordance with one exemplary embodiment, an LED module may be driven by AC power and may include a plurality of LEDs, wherein, when one cycle of the AC power is divided into a plurality of predetermined sections, a plurality of LED groups sequentially turned on in each of the predetermined sections and each including at least two LEDs is determined, and color temperatures of the at least two LEDs have a certain range of deviation with respect to a predetermined central color temperature.

The plural LEDs may be divided into two or more compartments having symmetric deviations from the predetermined central color temperature, one of the plural LED groups may be divided into the same number of subgroups as the compartments, and LEDs belonging to one compartment may belong to each of the subgroups.

The LEDs belonging to the same compartment may be uniformly distributed on an illumination surface.

In some embodiments, the LEDs may be sequentially driven by dividing sine wave AC power or pulsating AC power into at least two sections depending upon time.

Sine wave AC power or pulsating AC power may be divided into at least two sections depending upon levels, and the LEDs may be sequentially driven in such a manner that a turned-on group or turned-on groups are determined in a section at each level such that the number of LEDs belonging to the turned-on group or groups increases with increasing level.

The LED module may further include: a rectifier generating pulsating voltage by rectifying AC voltage; and a constant current driver connected to each of the LED groups of the plural LEDs to sequentially constant-current drive each of the LED groups.

The plural LED groups, which are sequentially turned on, may be sequentially arranged on the illumination surface in a clockwise or counterclockwise direction according to a turn-on sequence, and one of the at least two LEDs included in each LED group and the other LED may have symmetric deviations from the predetermined central color temperature.

The plural LED groups sequentially arranged may be repeatedly arranged in at least two cycles.

At least one pair of LED groups having the same turn-on sequence among the plural LED groups may be arranged to face each other.

The plural LED groups may occupy a broader area on the illumination surface in an earlier turn-on sequence.

The plural LED groups, which are sequentially turned on, may be arranged to alternate clockwise turn-on and counterclockwise turn-on, and one of the at least two LEDs included in each LED groups and the other LED may have symmetric deviations from the predetermined central color temperature.

In some embodiments, the plural LED groups, which are sequentially turned on, may be sequentially arranged from an inner side to an outer side or vice versa on the illumination surface according to a turn-on sequence, and one of the at least two LEDs included in each LED groups and the other LED may have symmetric deviations from the predetermined central color temperature.

The plural LED groups may occupy a broader area on the illumination surface in an earlier turn-on sequence.

According to exemplary embodiments, the LED module provides an advantage of use of LEDs having a color temperature deviation without deterioration in aesthetic appearance. In addition, the LED module provides advantages of improving efficiency of use of resources while reducing manufacturing costs of an LED/LED lamp.

Further, the LED module can realize a color temperature required for a final product using LEDs having a color temperature deviation, and can improve uniformity of emitted light and heat dissipation through arrangement of the LEDs.

DETAILED DESCRIPTION OF THE ILLUSTRATED EMBODIMENTS

Figure 1:
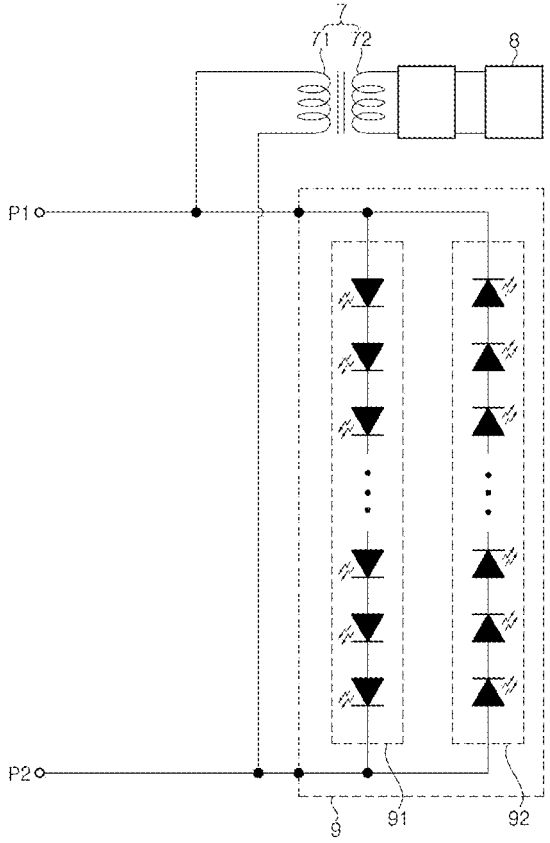
FIG. 1 is a circuit diagram showing a typical AC LED lamp including two AC power terminals and a light emitting module.

Hereinafter, exemplary embodiments of the present disclosure will be described in detail with reference to the accompanying drawings. The following embodiments are provided by way of example so as to fully convey the spirit of the present disclosure to those skilled in the art to which the present disclosure pertains. Accordingly, the present disclosure is not limited to the embodiments disclosed herein and can also be implemented in different forms. In the drawings, widths, lengths, thicknesses, and the like of elements can be exaggerated for clarity and descriptive purposes. It will be understood that when an element such as a layer, film, region or substrate is referred to as being "on" another element, it can be directly on the other element or intervening elements may also be present. In contrast, when an element is referred to as being "directly on" another element, there are no intervening elements present. Throughout the specification, like reference numerals denote like elements having the same or similar functions.

For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

As used herein, the term "LED group" refers to a set of a plurality of LEDs (or a plurality of light emitting cells) connected to each other in series/parallel/series-parallel and controlled as one unit in terms of operation thereof (that is, turned on/off together) by an LED driving module. In addition, the term "LED driving module" used herein refers to a module driving and controlling an LED by receiving input AC voltage and should be interpreted in a comprehensive and broad sense.

In addition, as used herein, the term "first forward voltage level VF1" refers to a critical voltage level capable of driving a first LED group, the term "second forward voltage level VF2" refers to a critical voltage level capable of driving first and second LED groups connected to each other in series, and the term "third forward voltage level VF3" refers to a critical voltage level capable of driving first to third LED groups connected to each other in series. That is, the term "n-th forward voltage level VFn" used herein refers to a critical voltage level capable of driving first to n-th LED groups connected to each other in series.

Further, the term "sequential drive type" refers to a driving manner in which a plurality of LED groups sequentially emits light along with increasing applied input voltage and is sequentially turned off along with decreasing applied input voltage in an LED driving module configured to drive LEDs by receiving applied input voltage having an amplitude varying with time.

Furthermore, symbols such as "V1, V2, V3 . . . t1, t2 . . . T1, T2, and T3" denoting arbitrary specific voltage, time point and temperature are used herein not to represent absolute values but to represent relative values distinguished from each other.

Figure 2:
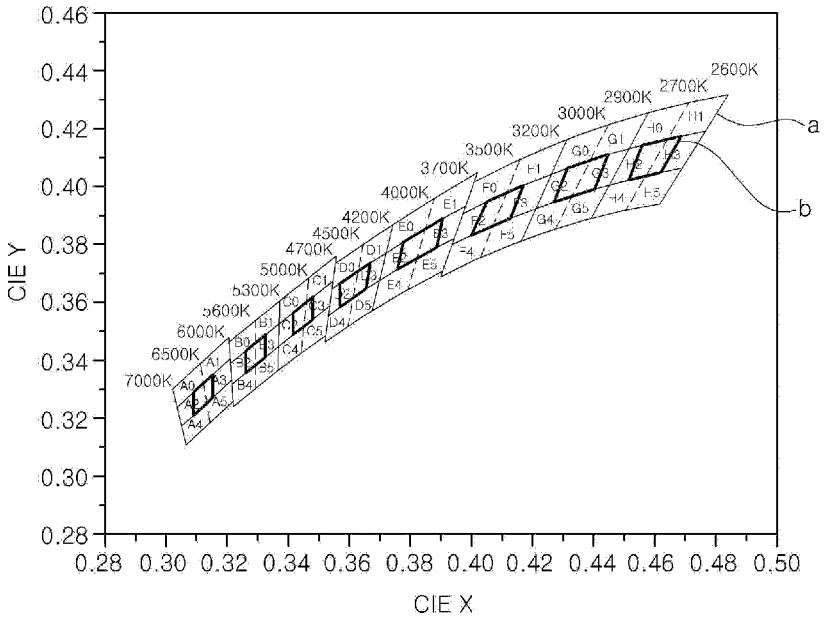
FIG. 2 is graph depicting criteria for classifying produced LEDs according to color temperature deviation.

FIG. 2 is a graph depicting criteria for classifying produced products according to color temperature values.

In the graph, ranges of color temperature values, which are marked by lines a and desired for final products, are shown, and the desired color temperature ranges sectioned by the lines a show color temperature ranges having larger deviations than ranges marked by lines b. In this graph, one color temperature range having deviations may be divided into six compartments. In addition, according to the present disclosure, LEDs belonging to one of two compartments facing each other are classified as an A rank, and LEDs belonging to the other compartment are classified as a B rank. As such, in the structure wherein an LED module includes LEDs classified into two categories, that is, the A rank and the B rank, when the LED module emits light, a color temperature felt by a human has a range similar to the desired color temperature range marked by the lines a in the graph. For example, when CIE XY coordinates are (X: 0.45, Y: 0.42; X: 0.43, Y: 0.38; X: 0.45, Y: 0.39; and X: 0.48, Y: 0.43), among six compartments H0 to H5 obtained by dividing this region into six equal parts, a PKG belonging to the compartment H0 and a PKG belonging to the compartment H5 facing the compartment H0 may be mounted, thereby producing one LED module product.

Figure 3:
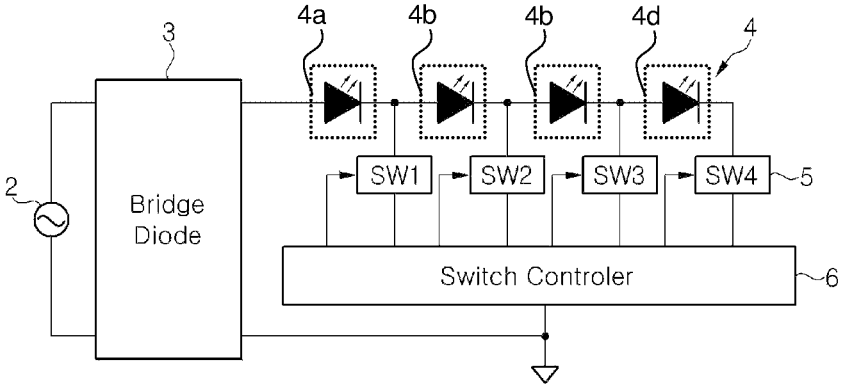
FIG. 3 is a circuit diagram showing a structure of an LED module including a sequential drive type LED driving device.

FIG. 3 shows a structure of an LED module including a sequential drive type LED driving device. As shown in FIG. 3, the sequential drive type LED driving device includes a bridge diode 3, switches 5 (SW1, SW2, SW3, SW4) and a switch controller 6, generates pulsating voltage by rectifying AC power 2 through the bridge diode 3 without a separate converter converting the AC power 2 into relatively uniform DC power, and supplies the generated pulsating voltage to an LED array 4. The LED array 4 includes a plurality of LED groups (e.g., a first LED group 4*a*, a second LED group 4*b*, a third LED group 4*c*, and a fourth LED group 4*d*), each of which includes at least one LED device.

The illustrated LED driving device controls switches 5 connected to the respective LED groups through the switch controller 6 such that, when the plural LED groups connected to each other in series have gradually increasing forward voltage levels Vf as the number of LED groups increases from an input terminal of the LED groups, the plural LED groups sequentially emit light according to waveforms of the pulsating voltage having an amplitude varying with time.

Figure 4:
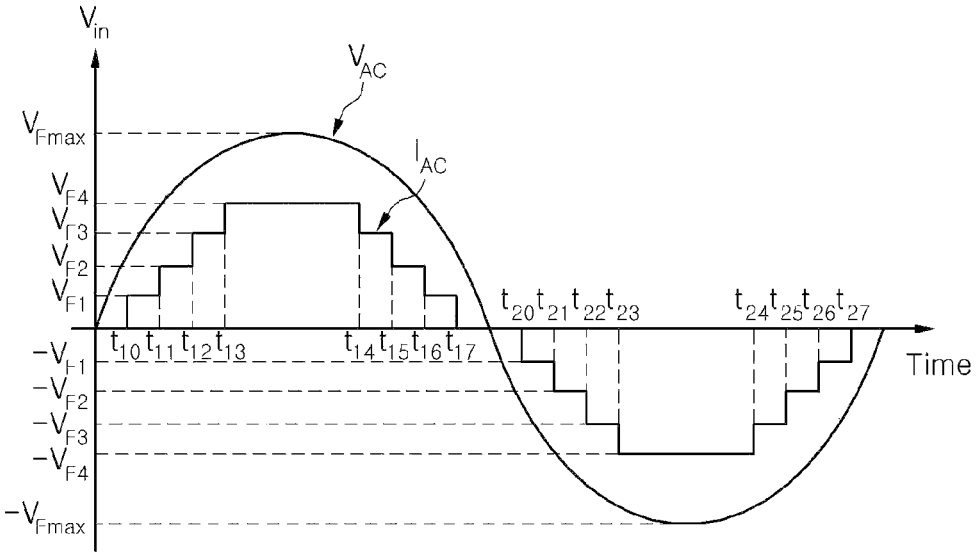
FIG. 4 is a waveform diagram showing AC voltage and alternating current of AC power supplied to the LED driving device of FIG. 3.

The illustrated LED driving device needs to be manufactured to exhibit electrical properties, such as power factor, total harmonic distortion, and the like, satisfying standards required for application thereof. That is, a typical LED driving device controls sequential light emission of a plurality of LED groups such that a waveform of drive current is formed to follow drive voltage of a pulsating voltage form. In this case, as shown in FIG. 4, since AC voltage and alternating current have the same phase in a commercial AC power source supplying AC power to the LED driving device, the LED driving device and products using the same exhibit improved properties in terms of power factor, total harmonic distortion and the like and. In addition, the LED driving device also has a merit of improving efficiency in use of light for one cycle by setting an early time point of turning on the LED groups and a late time point of turning off the LED groups emitting light.

Referring again to FIG. 4, AC voltage (Vac) of the AC power changes between $-V_{Fmax}$ and $V_{Fmax}$ over time. The LED module according to exemplary embodiments may include a plurality of LED groups, and the plural LED groups may be sequentially driven according to voltage levels of the AC voltage (Vac) of the AC power input to the LED module.

Specifically, when the voltage level of the AC voltage (Vac) falls within a first forward voltage level (that is, $V_{F1} \leq Vac < V_{F2}$), a first LED group may be turned on. In addition, when the voltage level of the AC voltage (Vac) falls within a second forward voltage level (that is, $V_{F2} \leq Vac < V_{F3}$), a second LED group may be turned on. Further, when the voltage level of the AC voltage (Vac) falls within a third forward voltage level (that is, $V_{F3} \leq Vac < V_{F4}$), a third LED group may be turned on. Furthermore, when the voltage level of the AC voltage (Vac) reaches $V_{F5}$ which is a higher voltage than $V_{F4}$, although $V_{F5}$ is not shown in FIG. 5, the voltage level of the AC voltage (Vac) falls within a fourth forward voltage level (that is, $V_{F4} \leq Vac < V_{F5}$), and a fourth LED group may be turned on.

Referring again to FIG. 4, it can be seen that the first LED group has the longest drive time period and that the fourth LED group has the shortest drive time period. Thus, the first LED group emitting light for the longest period of time emits the largest amount of heat, and the fourth LED group emits a relatively small amount of heat.

According to exemplary embodiments, there is provided an LED module which is driven in a sequential manner with respect to AC power as in the structure of FIG. 3 and can be manufactured using LEDs having aesthetic deviations.

Figure 5:
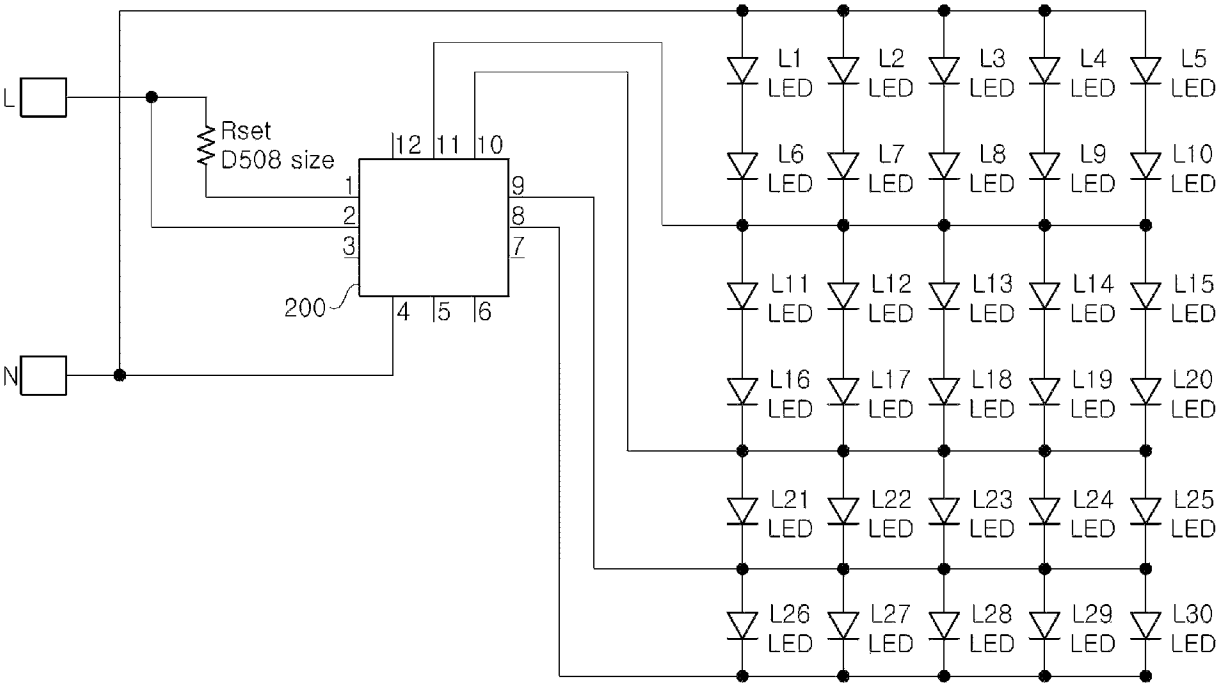
FIG. 5 is a circuit diagram showing an LED connecting structure of a sequential drive type LED module according to an exemplary embodiment.

FIG. 5 is a circuit diagram showing an LED connecting structure of a sequential drive type LED module according to an exemplary embodiment.

The structure according to this embodiment is a structure of an LED module sequentially driven according to four levels of voltage and realized using LEDs classified into two ranks, in which an AC Direct Integrated Circuit (IC) 200 configured to drive the LEDs using alternating current without separate rectification is used and one or more LEDs are connected to each of IC pins. This structure includes four LED groups, and a process of driving the four LED groups according to AC voltage (Vac) is as described above.

The illustrated LED module includes 30 LEDs, and AC power input to illustrated input terminals L, N may be pulsating power obtained by rectifying sine wave AC power using a rectifying device such as a bridge diode and the like.

The AC Direct IC 200 may provide a dimmer function and sequentially turns on LEDs from an IC pin 11 to an IC pin 8 with increasing voltage of the AC power input to the input terminals L, N.

Thus, LEDs L1 to L10 may form a first LED group 4*a* and LEDs L11 to L20 may form a second LED group 4*b*. In addition, LEDs L21 to L25 may form a third LED group 4*c* and LEDs L26 to L30 may form a fourth LED group 4*d*.

Figure 6:
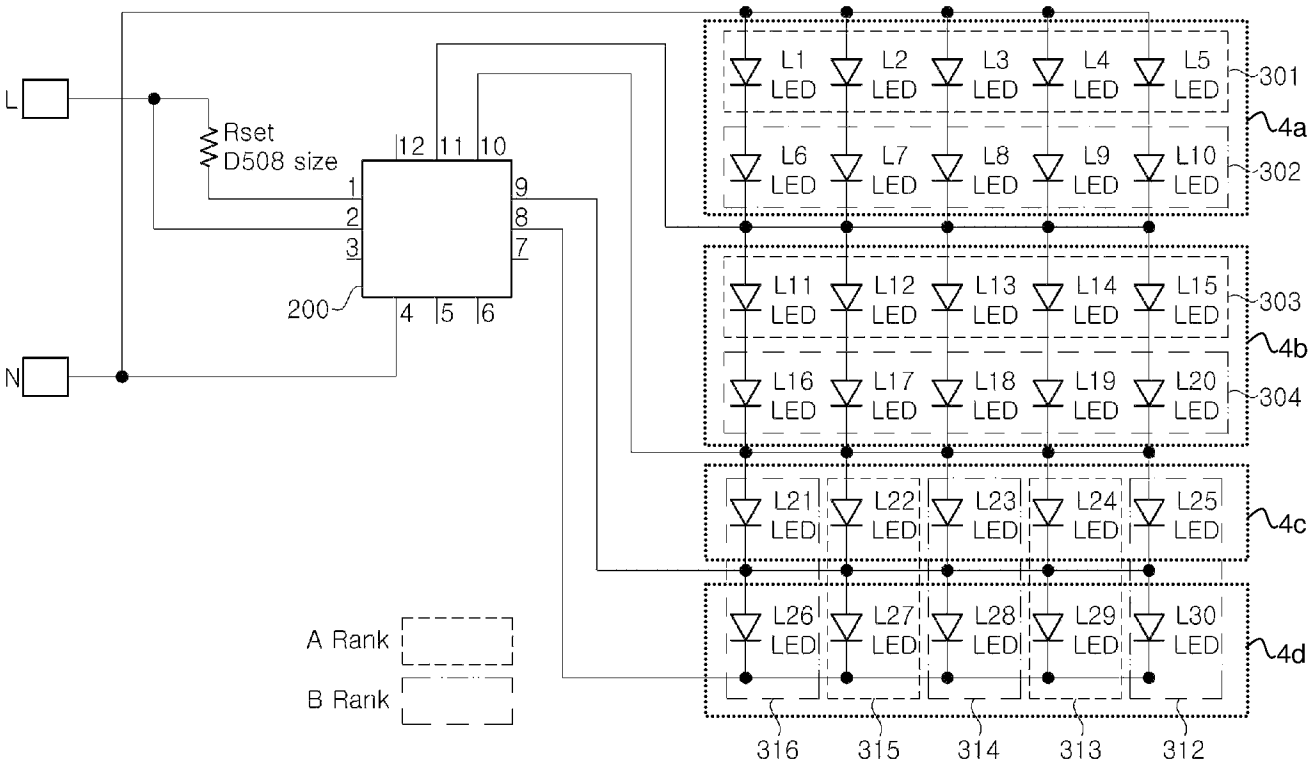
FIG. 6 is a circuit diagram showing one exemplary arrangement of LEDs classified as an A rank and LEDs classified as a B rank in the LED arrangement of FIG. 5 based on the criteria of FIG. 2.

FIG. 6 is a circuit diagram showing one exemplary arrangement of LEDs classified as the A rank and LEDs classified as the B rank in the LED arrangement of FIG. 5 based on the criteria of FIG. 2. In this arrangement structure, the LEDs L1 to L10 (that is, the first LED group 4*a*) turned on at the lowest voltage are divided into two subgroups such that the A rank LEDs are arranged in one subgroup 301 and the B rank LEDs are arranged in the other subgroup 302. Similarly, the LEDs L11 to L20 (that is, the second LED group 4*b*) turned on at the second lowest voltage are divided into two subgroups such that the A rank LEDs are arranged in one subgroup 303, and the B rank LEDs are arranged in the other subgroup 304. Similarly, the LEDs L21 to L25 (that is, the third LED group 4*c*) turned on at the third lowest voltage and the LEDs L26 to L30 (that is, the fourth LED group 4*d*) turned on at the highest voltage are also divided into A rank subgroups 313, 315 and B rank subgroups 312, 314, 316.

Figure 7:
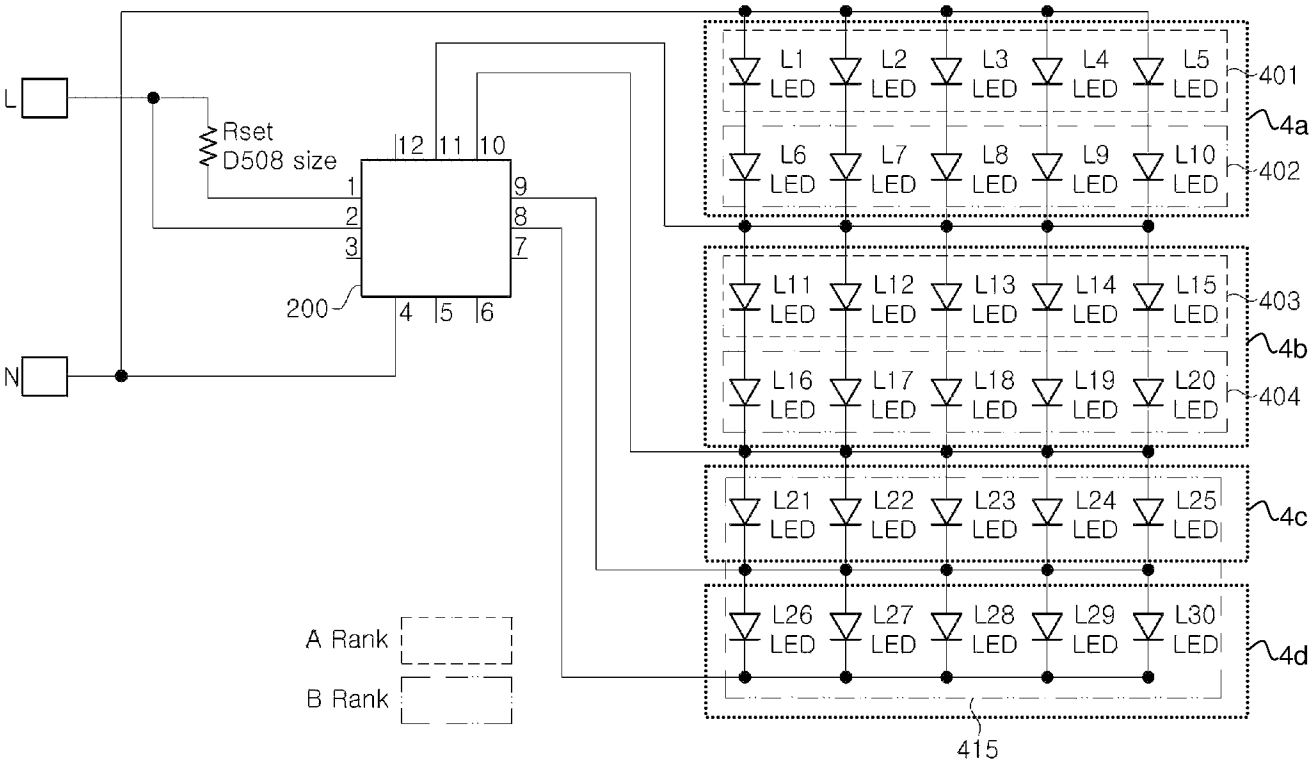
FIG. 7 is a circuit diagram showing another exemplary arrangement LEDs classified as the A rank and LEDs classified as the B rank in the LED arrangement of FIG. 5 based on the criteria of FIG. 2.

FIG. 7 is a circuit diagram showing another exemplary arrangement LEDs classified as the A rank and LEDs classified as the B rank in the LED arrangement of FIG. 5 based on the criteria of FIG. 2. In this arrangement structure, the LEDs L1 to L10 (the first LED group 4*a*) turned on at the lowest voltage are the A rank LEDs. The LEDs L11 to L20 (the second LED group 4*b*) turned on at the second lowest voltage are divided into two subgroups such that the A rank LEDs are arranged in one subgroup 403, and the B rank LEDs are arranged in the other subgroup 404. The LEDs L21 to L25 (the third LED group 4*c*) turned on at the third lowest voltage and the LEDs L26 to L30 (the fourth LED group 4*d*) turned on at the highest voltage are the B rank LEDs.

In FIGS. 6 and 7, an average of color temperatures of the LEDs belonging to the subgroups of the LEDs at each of drive voltages in each of the ranks is close to a reference color temperature. That is, the LEDs belonging to one subgroup are advantageously selected such that color temperatures of the LEDs have a certain range of deviation with respect to a desired central color temperature. When the LEDs in each of the A and B ranks are viewed on an illumination surface 840 of an LED lamp in FIGS. 5 and 6, the LEDs are shown as in FIG. 7.

Figure 8:
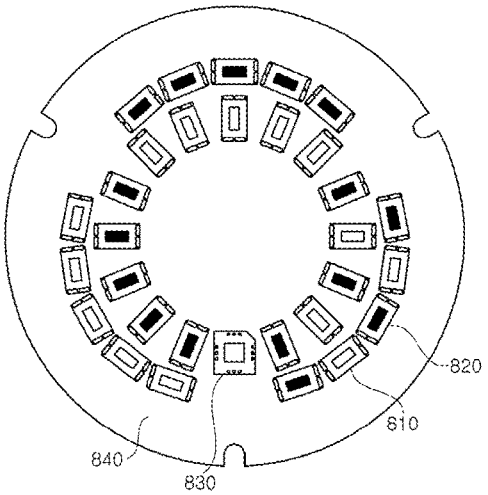
FIG. 8 is a plan view showing a front side of an LED lamp in which LEDs classified as the A rank and LEDs classified as the B rank based on the criteria of FIG. 2 are arranged.

Referring to FIG. 8, A rank LEDs 810, B rank LEDs 820 and an LED driving module 830 may be arranged on the illumination surface 840 of the LED lamp. As shown in FIG. 8, the A rank LEDs 810 and the B rank LEDs 820 are arranged to adjoin each other and are arranged such that the number of the A rank LEDs 810 can be the same as or similar to the number of the B rank LEDs 820.

FIGS. 9 and 10 are conceptual diagrams explaining arrangement of LED groups including LEDs classified as the A or B rank. Since FIGS. 9 and 10 are conceptual diagrams for explaining arrangement regions of the LED groups, the LEDs 810, 820 shown in FIG. 8 are omitted.

In FIGS. 9 and 10, region S1 represents a region in which the first LED group set forth above is arranged, region S2 represents a region in which the second LED group set forth above is arranged, region S3 represents a region in which the third LED group set forth above is arranged, and region S4 represents a region in which the third LED group set forth above is arranged. Since the first and second LED groups include the largest number of LEDs, the first and second LED groups occupy the broadest areas on the illumination surface 840. In addition, as described above, each of the LED groups includes the same or similar number of the A and B rank LEDs.

Figure 9A:
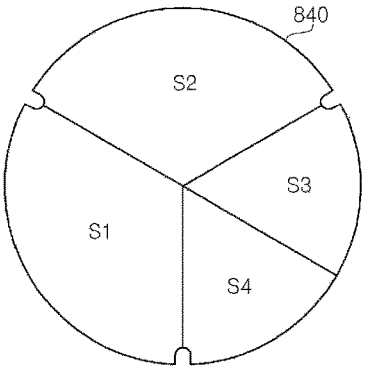
FIGS. 9A, 9B, 9C, 10A, and 10B are conceptual diagrams explaining arrangement of groups including LEDs classified as the A or B rank.

Referring to FIG. 9A, it can be seen that the regions S1 to S4 are sequentially arranged in the clockwise direction. Thus, in the exemplary embodiment of FIG. 9A, the LED group arrangement regions are sequentially turned on in the clockwise direction.

Figure 9B:
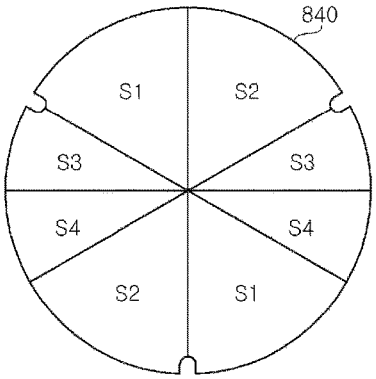

Referring to FIG. 9B, one region is divided into two regions, unlike the embodiment shown in FIG. 9A. That is, in an exemplary embodiment of FIG. 9B, the regions S1 to S4 are repeatedly arranged in two cycles. According to the exemplary embodiment of FIG. 9B, the regions are appropriately mixed, thereby improving uniformity of light emitted by the LED module. That is, the region S1, in which the first LED group emitting light for the longest period of time is arranged, is divided into two regions, thereby improving uniformity of light emitted by the LED module. In the exemplary embodiment of FIG. 9B, the LED group arrangement regions are sequentially turned on clockwise, and the regions in which the same LED groups are arranged may be simultaneously turned on. That is, the regions S1 and S1 facing each other, or the regions S2 and S2 facing each other may be simultaneously turned on.

Figure 9C:
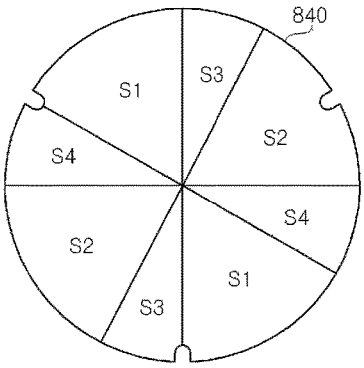

Referring to FIG. 9C, arrangement regions are repeatedly arranged in two cycles in order of S1-S3-S2-S4 on the illumination surface 840. In an exemplary embodiment of FIG. 9C, although the arrangement regions are arranged on the illumination surface 840 in order of S1-S3-52-54-S1-S3-S2-S4 in the clockwise direction, the arrangement regions are turned on in order of S1-S2-S3-S4, as in other embodiments. Thus, in the exemplary embodiment of FIG. 9C, turn-on clockwise and turn-on counterclockwise may alternately occur. In addition, among the plural LED groups, the first and second LED groups emit the highest amount of heat. Thus, in the exemplary embodiment of FIG. 9C, the arrangement regions emitting a high amount of heat are separated from each other, thereby preventing heat from being concentrated on a specific region. Thus, the LED module can have improved heat dissipation capabilities. In the exemplary embodiments set forth above, the arrangement regions are sequentially arranged in the clockwise direction, without being limited thereto.

Figure 10A:
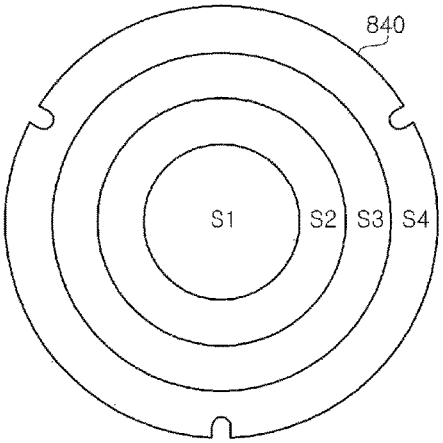
Figure 10B:
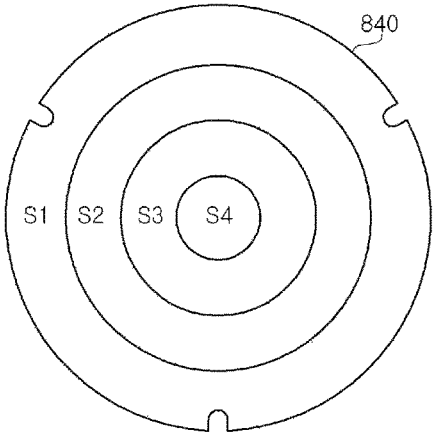

Referring to FIGS. 10A and 10B, it can be seen that the arrangement regions are arranged from an inner side to an outer side or vice versa on the illumination surface 840, unlike in the exemplary embodiment of FIGS. 9A, 9B, and 9C. That is, the arrangement regions are sequentially arranged from the inner side to the outer side in order of S1-S2-S3-S4 in FIG. 10A, and sequentially arranged from the outer side to the inner side in order of S1-S2-S3-S4 in FIG. 10B.

According to the exemplary embodiment of FIG. 10A, the regions S1 and S2 having the longest period of light emission are arranged in central regions of the illumination surface 840, thereby improving linearity of light emitted from the LED module. That is, according to this exemplary embodiment, the LED module can be used as a head lamp for automobiles. In addition, according to the exemplary embodiment of FIG. 10B, the regions S1 and S2 having the longest period of light emission are arranged in outer regions, thereby improving side light emission of the LED module. Thus, according to this exemplary embodiment, the LED module can be used as side light emission-reinforced illumination.

Although some exemplary embodiments have been described herein, it should be understood by those skilled in the art that these embodiments are given by way of illustration only, and that various modifications, variations and alterations can be made without departing from the spirit and scope of the invention. Therefore, the embodiments and the accompanying drawings should not be construed as limiting the technical spirit of the present disclosure, but should be construed as illustrating the technical spirit of the present disclosure. The scope of the invention should be interpreted according to the following appended claims as covering all modifications or variations derived from the appended claims and equivalents thereof.

What is claimed is:

1. A light-emitting diode (LED) module, comprising:

LEDs driven by pulsating voltage generated from an alternating current (AC) power; and LED groups, each of the LED groups comprising at least two of the LEDs, wherein the LED module is configured to divide one cycle of the AC power into sections and sequentially turn on the LED groups based on the sections of the one cycle of the AC power, wherein color temperatures of the at least two LEDs have a range of deviation from a central color temperature, and wherein a single LED group has a first LED of a first color temperature connected in series to a second LED of a second color temperature different from the first color temperature and connected in parallel to a third LED of the first color temperature.

2. The LED module of claim 1, wherein:

the LEDs are divided into at least two compartments having symmetric deviations from the central color temperature, one of the LED groups is divided into the same number of subgroups as the at least two compartments, and LEDs belonging to one of the at least two compartments belong to each of the subgroups.

3. The LED module of claim 2, wherein the LEDs belonging to the same compartment are uniformly distributed on an illumination surface.

4. The LED module of claim 1, wherein the LEDs are sequentially driven by at least one of dividing a sine wave of AC power and pulsating AC power into at least two sections based on time.

5. The LED module of claim 1, wherein:

the LED module is configured to divide at least one of a sine wave of AC power and pulsating AC power into at least two sections based on voltage levels, and the LEDs are sequentially driven such that a number of LEDs belonging to a turned-on group or turned-on groups increases with increasing voltage levels.

6. The LED module of claim 1, further comprising:

a rectifier generating the pulsating voltage by rectifying AC voltage; and a constant current driver connected to each of the LED groups to sequentially drive each of the LED groups with a constant current.

7. The LED module of claim 1, wherein:

the LED groups are sequentially arranged on an illumination surface in a clockwise direction or a counterclockwise direction according to a turn-on sequence; and two LEDs of each LED group have symmetric deviations from the central color temperature.

8. The LED module of claim 7, wherein the LED groups sequentially arranged on the illumination surface in the clockwise direction or the counterclockwise direction according to a turn-on sequence are repeatedly arranged in at least two cycles.

9. The LED module of claim 8, wherein at least one pair of LED groups having the same turn-on sequence among the LED groups is arranged to face each other.

10. The LED module of claim 7, wherein the LED groups occupy a broader area on the illumination surface in an earlier turn-on sequence.

11. The LED module of claim 1, wherein:

the LED groups are arranged to alternate clockwise turn-on and counterclockwise turn-on; and two LEDs of each LED group have symmetric deviations from the central color temperature.

12. The LED module of claim 1, wherein:

the LED groups are sequentially arranged from an inner side to an outer side or from an outer side to an inner side on an illumination surface according to a turn-on sequence, and two LEDs of each LED group have symmetric deviations from the central color temperature.

13. The LED module of claim 12, wherein the LED groups occupy a broader area on the illumination surface in an earlier turn-on sequence.

14. The LED module of claim 1, wherein at least one LED group has a fourth LED of a fourth color temperature connected in parallel to a fifth LED of a fifth color temperature different form the fourth color temperature.

15. The LED module of claim 1, wherein the LED groups are connected in series to each other.

16. The LED module of claim 1, wherein the LEDs of each LED group are configured to turn on or off as one unit.

* * * * *